US009080380B2

(12) United States Patent
Thompson

(10) Patent No.: US 9,080,380 B2
(45) **Date of Patent: *Jul. 14, 2015**

(54) DOOR LITE FRAME WITH NESTABLE FRAME COMPONENTS

(71) Applicant: MASONITE CORPORATION, Tampa, FL (US)

(72) Inventor: Douglas Thompson, Tampa, FL (US)

(73) Assignee: Masonite Corporation, Tampa, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/565,005

(22) Filed: Dec. 9, 2014

(65) Prior Publication Data

US 2015/0096253 A1 Apr. 9, 2015

Related U.S. Application Data

(62) Division of application No. 14/264,797, filed on Apr. 29, 2014, now Pat. No. 8,904,733, which is a division of application No. 13/692,149, filed on Dec. 3, 2012, now Pat. No. 8,707,639.

(60) Provisional application No. 61/565,719, filed on Dec. 1, 2011.

(51) Int. Cl.

| | |
|---|---|
| ***E06B 3/988*** | (2006.01) |
| ***E06B 3/58*** | (2006.01) |
| ***E06B 1/36*** | (2006.01) |
| ***E06B 3/96*** | (2006.01) |
| ***E06B 3/968*** | (2006.01) |

(Continued)

(52) U.S. Cl.

CPC ..... *E06B 3/5892* (2013.01); *E06B 1/36* (2013.01); *E06B 3/968* (2013.01); *E06B 3/9636* (2013.01); *E06B 3/9642* (2013.01); *E06B 3/9681* (2013.01); *E06B 3/9684* (2013.01); *E06B 3/5864* (2013.01); *E06B 2003/6217* (2013.01)

(58) Field of Classification Search

CPC ..... E06B 1/36; E06B 3/968; E06B 3/5892; E06B 3/9636; E06B 2003/6217; E06B 3/5864

USPC ..... 52/204.7, 204.55, 204.1, 213, 656.4, 52/656.9; 49/504, 505

See application file for complete search history.

(56) References Cited

U.S. PATENT DOCUMENTS

| | | | |
|---|---|---|---|
| 3,750,358 | A | 8/1973 | Lewkowitz |
| 3,760,543 | A | 9/1973 | McAllister |
| 3,903,669 | A | 9/1975 | Pease, Jr. et al. |

(Continued)

FOREIGN PATENT DOCUMENTS

| | | | |
|---|---|---|---|
| EP | 1500771 | A1 | 1/2005 |

*Primary Examiner* — Chi Q Nguyen

(74) *Attorney, Agent, or Firm* — Berenato & White, LLC

(57) ABSTRACT

A door lite frame comprises a first frame component comprising first screw bosses and first grip sockets, and a second frame component comprising second screw bosses and second grip sockets. The first and second frame components are constructed to permit arrangement of the first and second frame components in an assembled state and a nested state with respect to one another. In the assembled state, the first screw bosses are correspondingly aligned with the second screw bosses, and the first and second frame components are secured to each other. In the nested state, at least one of the first screw bosses of the first frame component is mated with at least one of the second grip sockets of the second frame component.

21 Claims, 19 Drawing Sheets

(51) Int. Cl.
*E06B 3/964* (2006.01)
*E06B 3/62* (2006.01)

(56) References Cited

U.S. PATENT DOCUMENTS

| | | | |
|---|---|---|---|
| 4,241,556 | A | 12/1980 | Bursk |
| D262,404 | S | 12/1981 | Bittner |
| 4,523,408 | A | 6/1985 | McConnell |
| 4,920,718 | A | 5/1990 | Artwick et al. |
| 4,947,597 | A | 8/1990 | Simpson |
| 4,989,381 | A | 2/1991 | De Block et al. |
| 5,018,330 | A | 5/1991 | Lewkowitz |
| 5,105,597 | A | 4/1992 | Wilkening |
| D327,747 | S | 7/1992 | Wilkening |
| 5,133,168 | A | 7/1992 | Neilly |
| 5,577,355 | A | 11/1996 | Leonelli |
| 5,636,484 | A | 6/1997 | DeBlock |
| 5,644,881 | A | 7/1997 | Neilly |
| 5,765,325 | A | 6/1998 | DeBlock |
| 5,834,124 | A | 11/1998 | Pease, III et al. |
| 5,894,706 | A | 4/1999 | Herbst |
| 5,901,768 | A | 5/1999 | Herbst |
| 6,151,849 | A | 11/2000 | Twigg et al. |
| 6,272,801 | B1 | 8/2001 | Suh |
| 6,318,037 | B1 | 11/2001 | Hansen |
| 6,347,491 | B1 | 2/2002 | Legrand |
| 6,546,682 | B1 | 4/2003 | DeBlock et al. |
| 6,553,735 | B1 | 4/2003 | Wang Chen |
| 6,574,935 | B2 | 6/2003 | Wang Chen |
| 6,688,064 | B1 | 2/2004 | Swanick |
| 6,694,701 | B2 | 2/2004 | Wang |
| 6,715,245 | B2 | 4/2004 | Lewkowitz |
| 6,922,946 | B2 | 8/2005 | Gerard |
| 6,925,767 | B2 | 8/2005 | Krochmal et al. |
| 7,086,206 | B2 | 8/2006 | Wang et al. |
| D567,393 | S | 4/2008 | Ouellette et al. |
| 7,386,959 | B2 | 6/2008 | Ouellette |
| D613,878 | S | 4/2010 | Walsh et al. |
| 7,757,365 | B2 | 7/2010 | Ouellette |
| D625,838 | S | 10/2010 | Walsh et al. |
| D631,172 | S | 1/2011 | Pagryzinski et al. |
| 8,707,639 | B2 | 4/2014 | Thompson |
| 8,813,442 | B1 * | 8/2014 | Edwards et al. ..... 52/204.5 |
| 8,904,733 | B2 | 12/2014 | Thompson |
| 2003/0000163 | A1 | 1/2003 | Lamanna |
| 2006/0198124 | A1 | 9/2006 | Copland |
| 2007/0193140 | A1 | 8/2007 | Carnick et al. |
| 2008/0245003 | A1 | 10/2008 | Kon et al. |

* cited by examiner

DOOR LITE FRAME WITH NESTABLE FRAME COMPONENTS

CROSS-REFERENCE TO RELATED APPLICATION

This Application is related to U.S. Provisional Application Ser. No. 61/565,719 filed Dec. 1, 2011 by Thompson, D. This application is also a divisional of U.S. application Ser. No. 14/264,797, filed on Apr. 29, 2014, now U.S. Pat. No. 8,904,733 which is a divisional of U.S. application Ser. No. 13/692,149, filed on Dec. 3, 2012, now U.S. Pat. No. 8,707,639. These disclosures are hereby incorporated herein by reference in their entirety and to which priority is claimed.

FIELD OF THE INVENTION

The present invention relates to frames for door lites in general and, more particularly, to door lite frame components that are nestable with one another.

BACKGROUND OF THE INVENTION

Doors, especially entry doors for residential and commercial housing, often are provided with a partially or fully transparent window-like glazing panel called a lite that may be made of, for example, insulated glass or plastics, such as polycarbonate. Frames for the door lites are typically used for maintaining the glazing panel in place on the door. Typical door lite frames include two frame components or halves that are positioned on opposite sides of the glazing panel and fastened or otherwise interconnected to one another and to the door to secure the glazing panel to the door.

It is not convenient or efficient to transport assembled door lite frames because they are relatively bulky and take up much room. It is much more desirable to transport the door lite frames in an unassembled state. However, doing so can cause damage to the door lite frames in transport. With this in mind, it would be advantageous to provide improved door lite frame components that can be easily and cost-effectively nested together with one another for convenient and safe transport.

SUMMARY OF THE INVENTION

A first aspect of the invention provides a door lite frame comprising a first frame component including first screw bosses and first grip sockets, and a second frame component including second screw bosses and second grip sockets, with the first and second components constructed to permit their arrangement in an assembled state and a nested state with respect to one another. In the assembled state, the first screw bosses are correspondingly aligned with the second screw bosses, and the first and second frame components are secured to one another. In the nested state, at least one of the first screw bosses of the first frame component is mated with at least one of the second grip sockets of the second frame component, thus providing convenient and safe transportation of the door lite frame components.

According to a second aspect of the invention, a door is provided that features a door body having an opening therethrough, a door lite frame secured to the door body so as to extend about a periphery of the opening, and a glazing panel having a periphery and positioned within the door lite frame so that the door lite frame extends along the periphery of the glazing panel. The door lite frame comprises a first frame component comprising first screw bosses and first grip sockets, and a second frame component comprising second screw bosses and second grip sockets. The first and second frame components is constructed to permit arrangement of the first and second frame components in an assembled state and a nested state with respect to one another. In the assembled state, the first screw bosses are correspondingly aligned with the second screw bosses and the first and second frame components are adapted to extend along the periphery of the glazing panel for securing the glazing panel to the first and second door skins, while in the nested state, at least one of the first screw bosses of the first frame component is mated with at least one of the second grip sockets of the second frame component.

Other aspects of the invention, including apparatus, systems, methods, and the like which constitute part of the invention, will become more apparent upon reading the following detailed description of the exemplary embodiments and viewing the drawings.

BRIEF DESCRIPTION OF THE DRAWINGS

The accompanying drawings are incorporated in and constitute a part of the specification. The drawings, together with the general description given above and the detailed description of the exemplary embodiments and methods given below, serve to explain the principles of the invention. In such drawings.

FIG.

DETAILED DESCRIPTION OF EXEMPLARY EMBODIMENTS AND EXEMPLARY METHODS

Figure 1:
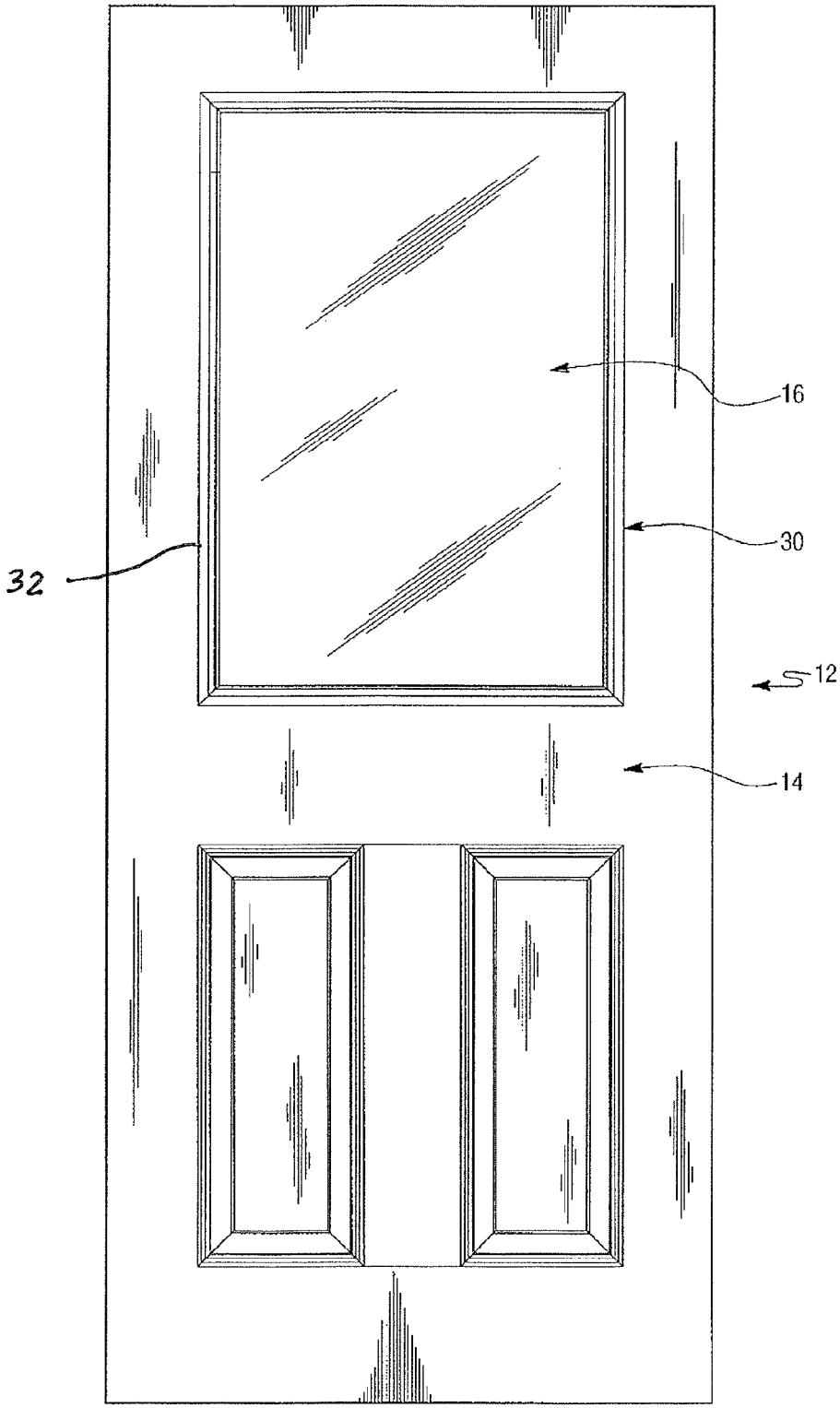
FIG. 1 is an elevational view of a door according to an exemplary embodiment of the invention.

Reference will now be made in detail to exemplary embodiments and methods of the invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in connection with the exemplary embodiments and methods.

This description of exemplary embodiments is intended to be read in connection with the accompanying drawings, which are to be considered part of the entire written description. In the description, relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship. Additionally, the word "a" as used in the claims means "at least one".

Figure 2:
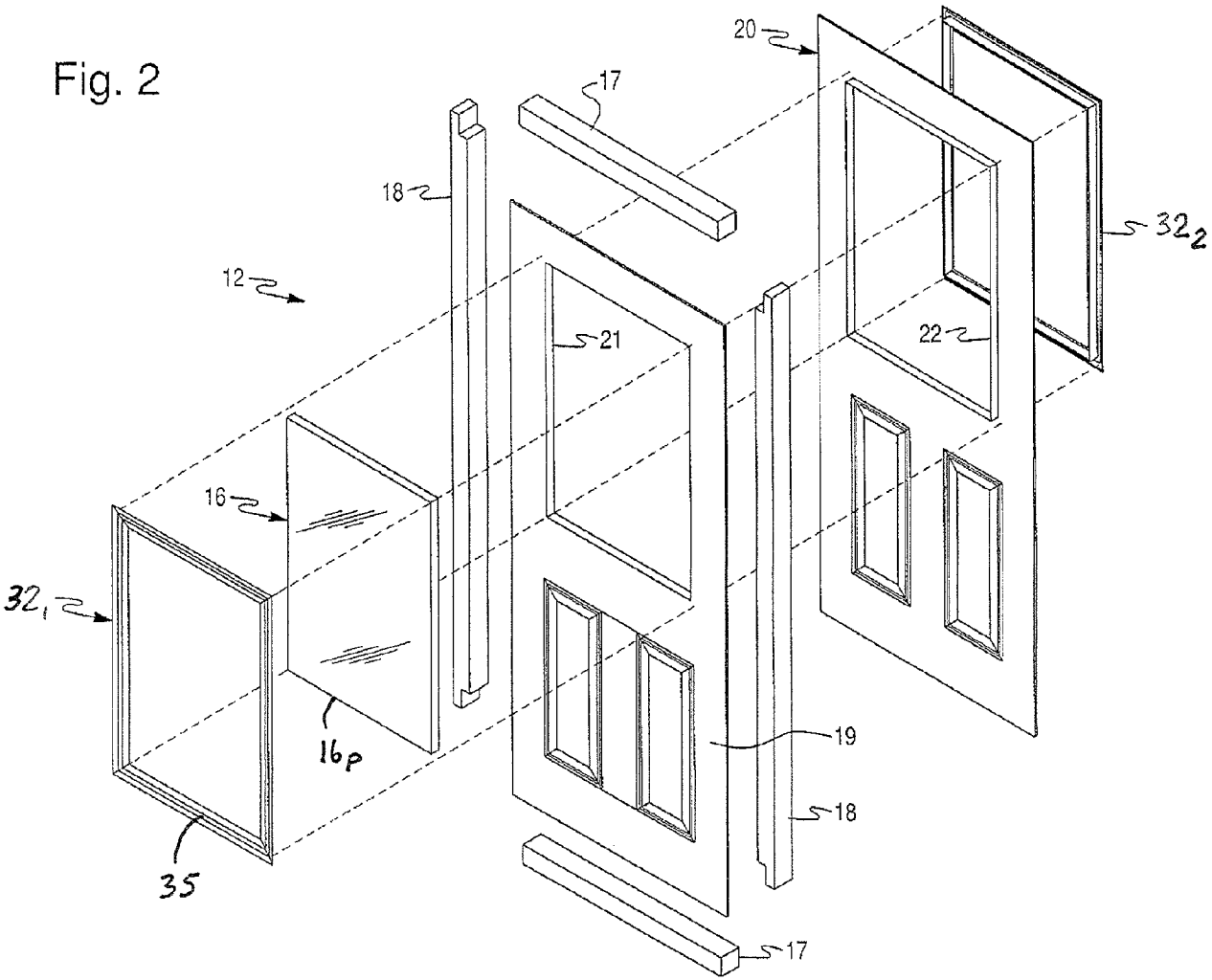
FIG. 2 is an exploded assembly drawing of the door of FIG. 1.

FIGS. 1 and 2 of the drawings illustrate a door according to an exemplary embodiment of the present invention indicated generally by reference numeral 12. The door 12 includes a door body 14 provided with an opening for receiving a translucent panel (door lite glass, glazing panel) 16, such as an impact-rated glass, and a high-impact plastic door lite frame 30 extending along a periphery 16*p* of the translucent panel 16. The door 12 may be for residential, business, or industrial use. Although illustrated as a main exterior entry door with a panel design, it should be understood that the door 12 may contain no panels, i.e., a flush door. Further, the door 12 may comprise a patio door.

According to the exemplary embodiment of the present invention as best illustrated in detail in FIG. 2, the door body 14 includes first and second door skins (also known as door facings) 19 and 20, respectively, top and bottom rails 17, and left and right stiles 18. The rails 17 and stiles 18 collectively define a rectangular door frame having opposite first and second faces. The first and second door skins 19 and 20 are secured to opposite faces of the door frame. Typically, adhesive is used to secure the door skins 19 and 20 to the door frame. In the case of metallic (e.g., steel) door skins 19 and 20, mechanical fastening and the like, for example, may be used. Typically, the first and second door skins 19 and 20 are secured to each other so as to form a cavity therebetween. The cavity of the door 12 optionally is filled with a core material, such as expanded foam insulating material. Additional or alternative core materials may be used. Alternatively, the door 12 may be a solid core door.

The first and second door skins 19 and 20 may be molded from an appropriate polymer material and have a thickness of, for example, about 1 mm to about 4 mm. The selected material of the door skins 19 and 20 can be sheet molding compound (SMC) with reinforcement (e.g., fiber glass, cellulosic material, etc.), metal (e.g., steel), wood, medium density fiberboard, high density fiberboard, or other materials suitable for the contemplated use. The door skins 19 and 20 may be made of the same or different materials. The door skins 19 and 20 may be molded from such materials as fiberglass reinforced plastics, pressed board, thermosetting compounds (e.g., vinyl esters), thermoplastics (e.g., polypropylene, polystyrenes), cellulosic material and resin composites, or other moldable materials. The outer surfaces of the door skins 19 and 20 can be smooth or can have a simulated wood grain. The depth of the wood grain optionally is about 0.05 mm to about 0.2 mm. An inner surface of the door skins 19 and 20 may have a relatively rough or textured surface to increase the surface area for adhesion to the door frame. The roughened inner surface may provide stronger bonds between the door skins 19 and 20, the foam material, the rails 17, and the stiles 18.

The first and second door skins 19 and 20 are each provided with respective openings 21 and 22 therethrough. The openings 21, 22 are aligned with each other for defining the opening in the door body 14 and receiving the translucent panel (e.g., door lite) 16. While the openings 21, 22 are shown in FIGS. 1 and 2 as possessing a rectangular shape, they can have any configuration, provided that the openings are complementary. For example, the first and second door skins 19, 20 may be provided with the openings 21, 22 having a configuration including a semielliptical portion and an integrated rectangular portion. It would be apparent to one skilled in the art that other configurations (e.g., circular, polygonal, random) may be provided.

The translucent panel 16 may be high impact rated, and designed to successfully pass Testing Application Standard 201-94 (TAS 201) based on a missile velocity of 35 miles per hour and Testing Application Standard 203-94 (TAS 203) based on a 9000-cycle regime applied consecutively. The translucent panel 16 may be a preassembled single or multiple (e.g., two) pane unit or cassette. The panel 16 may include a peripheral rim surrounding the pane(s). In the case of a multiple pane unit, the peripheral rim may serve to seal the area between the panes. As referred to herein, the term translucent includes materials which permit light to pass through but diffuse the light so that persons, objects, etc. on the opposite side are not clearly visible, and also includes transparent materials which permit light to pass through with sufficiently small or no diffusion so that persons, objects, etc. on the opposite side are clearly visible. The translucent panel 16 may be comprised of any material known in the art, such as clear glass, annealed glass, tempered glass and various plastics. Additionally, the translucent panel 16 may be tinted or colored, or possess tinted or colored components, as may be desired. The translucent panel 16 may be designed in any configuration known in the art, and may also be installed as a side lite, a transom lite, or in a similar application.

The door lite frame 30 comprises two opposite frame components or halves $\mathbf{32}_1$ and $\mathbf{32}_2$. The interior (or first) frame half $\mathbf{32}_1$ and the exterior (or second) frame half $\mathbf{32}_2$ are configured to mate with each other in order to hold the translucent panel 16 in place therebetween when assembled on the door 12. As best shown in FIGS. 1 and 2, the first and second frame halves $\mathbf{32}_1$, $\mathbf{32}_2$ interconnect the door body 14 to the translucent panel 16. According to the exemplary embodiment of the present invention, the two door lite frame halves $\mathbf{32}_1$ and $\mathbf{32}_2$ are substantially identical and collectively form the single door lite frame 30. Alternatively, the first and second frame halves $\mathbf{32}_1$, $\mathbf{32}_2$ may have different ornamental designs, provided that mating surfaces thereof are designed to mate up and nest as described herein below.

In view of the structural similarities of the first and second door lite frame halves $\mathbf{32}_1$ and $\mathbf{32}_2$, and in the interest of simplicity, the following discussion will use a reference numeral without a subscript number to designate both of the door lite frame halves. For example, the reference numeral 32 will be used when generically referring to the door lite frame halves $\mathbf{32}_1$ and $\mathbf{32}_2$ rather than reciting both reference numerals. Accordingly, because the two door lite halves $\mathbf{32}_1$ and $\mathbf{32}_2$ are structurally similar, only one of the door lite frame halves $\mathbf{32}_1$ and $\mathbf{32}_2$ will be described in detail hereinbelow.

The first and second frame halves $\mathbf{32}_1$ and $\mathbf{32}_2$ of the door lite frame 30 may be connected to each other in two different states: an assembled state and a nested state of the door lite frame 30. In the assembled state, illustrated in FIGS. 11, 12A and 12B, the first and second frame halves $\mathbf{32}_1$ and $\mathbf{32}_2$ are generally connected to each other so as to securely hold the translucent panel 16 in place therebetween and form the door lite frame 30 assembled on the door 12. In the nested state, illustrated in FIGS. 8, 9A, 10A-10C, 13A and 13B, the first and second frame halves $\mathbf{32}_1$ and $\mathbf{32}_2$ are usually temporarily directly connected to each other in a nested manner so as to facilitate storage and/or transportation of the frame halves $\mathbf{32}_1$ and $\mathbf{32}_2$. It should be understood that when elements are referred to as being "directly connected" or "directly coupled," there are no intervening elements present.

As illustrated in detail in FIGS. 3-7B, the door lite frame half 32, according to the exemplary embodiment of the present invention, is a single integral piece formed by plastic injection molding of, for example, polystyrene. Other suitable plastics or other materials known in the art may be used. Further according to the exemplary embodiment of the present invention, the frame half 32 is generally rectangular in shape and comprises two pairs of opposite frame members: substantially identical top and bottom frame members 33*a* and 33*b*, respectively, and also substantially identical right and left side frame members 34*a* and 34*b*, respectively, shown in FIGS. 3, 5A and 5B. The door lite frame half 32 has an exposed exterior side 35 and an interior side 36 facing the door 12 and/or the translucent panel 16 when assembled and located opposite the exterior side 35. An exposed surface 35*a* of the exterior side 35 provides an ornamental appearance of the door lite frame half 32. Appropriate shapes for the exterior surface 35*a* are known in the art. Often, the surface is configured and/or textured to simulate the appearance of wood molding. The interior side 36 of the frame half 32 includes a door engagement portion 38 provided to engage the door body 14, and a glass engagement portion 40 provided to engage the translucent panel 16. Each of the door engagement portion 38 and the glass engagement portion 40 defines a channel 39 and 41, respectively, facing the door 12 or the translucent panel 16, respectively. A caulk or other sealant may be installed within the channels 39 and 41 (best shown in FIGS. 7A and 7B) to enhance sealing against the door 12 or the translucent panel 16.

Figure 3:
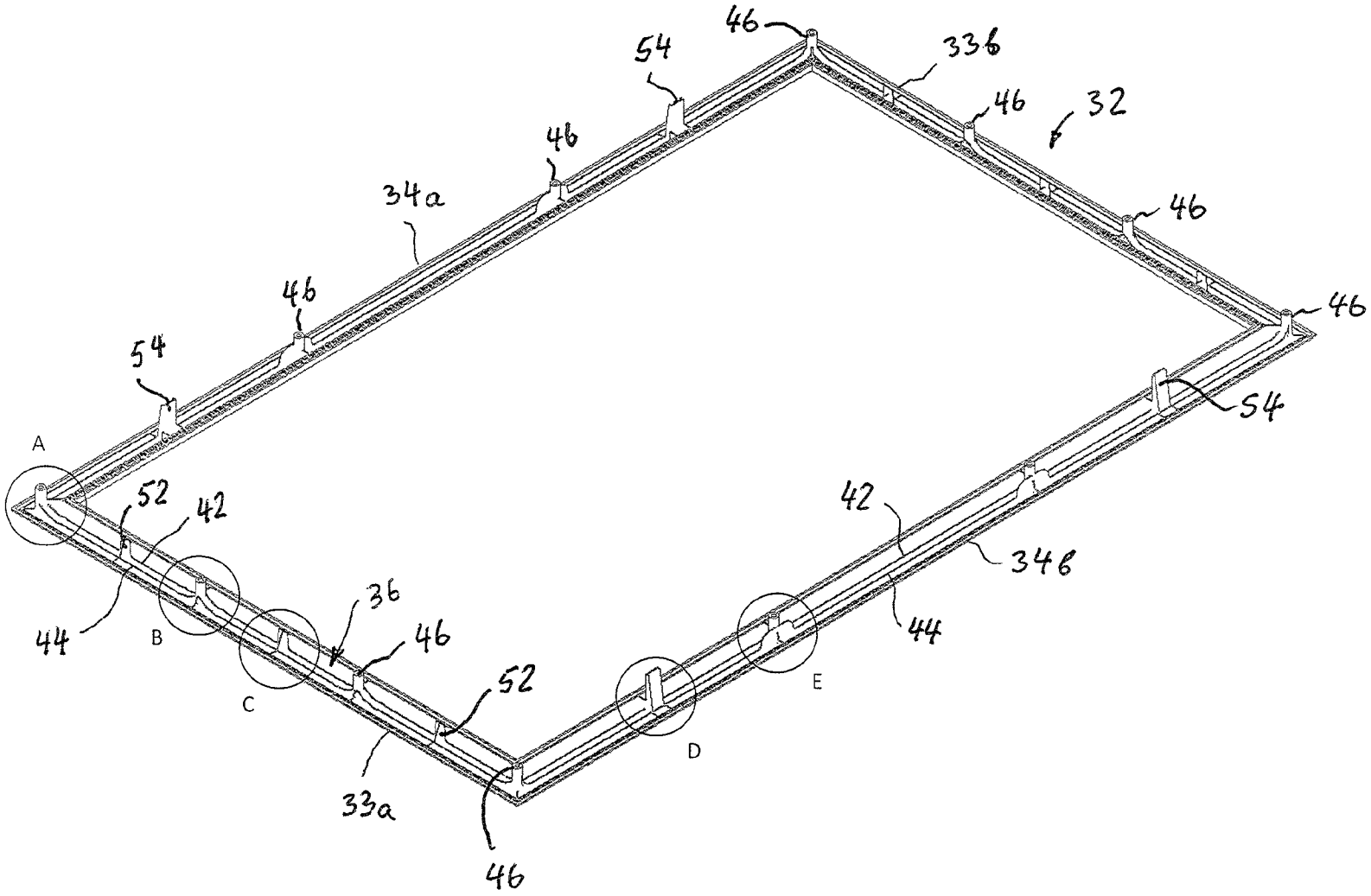
FIG. 3 is a perspective view of a door lite frame component of the door of FIGS. 1 and 2.
Figure 5A:
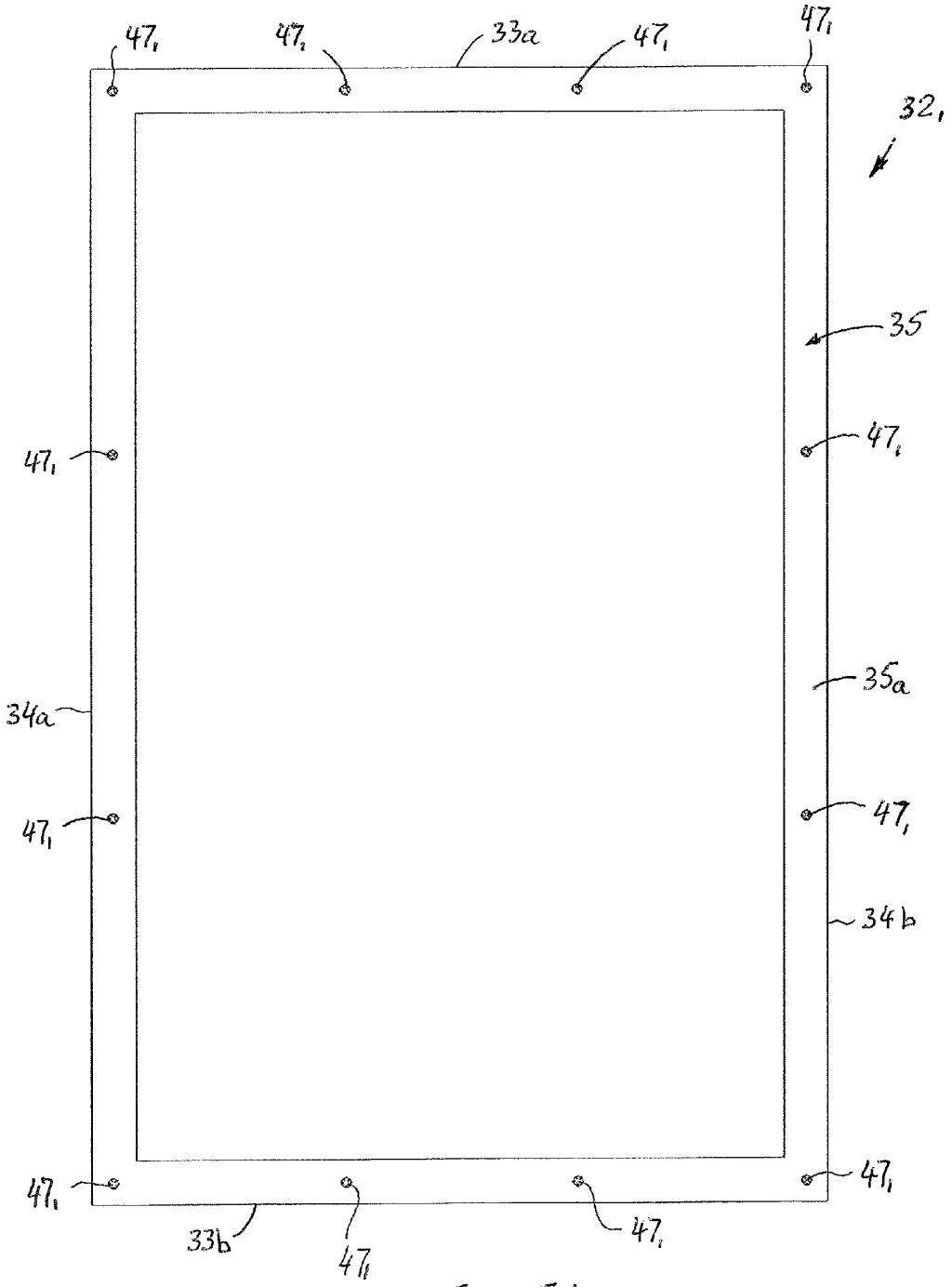
FIG. 5A is a front view of the door lite frame component of FIG. 3.
Figure 5B:
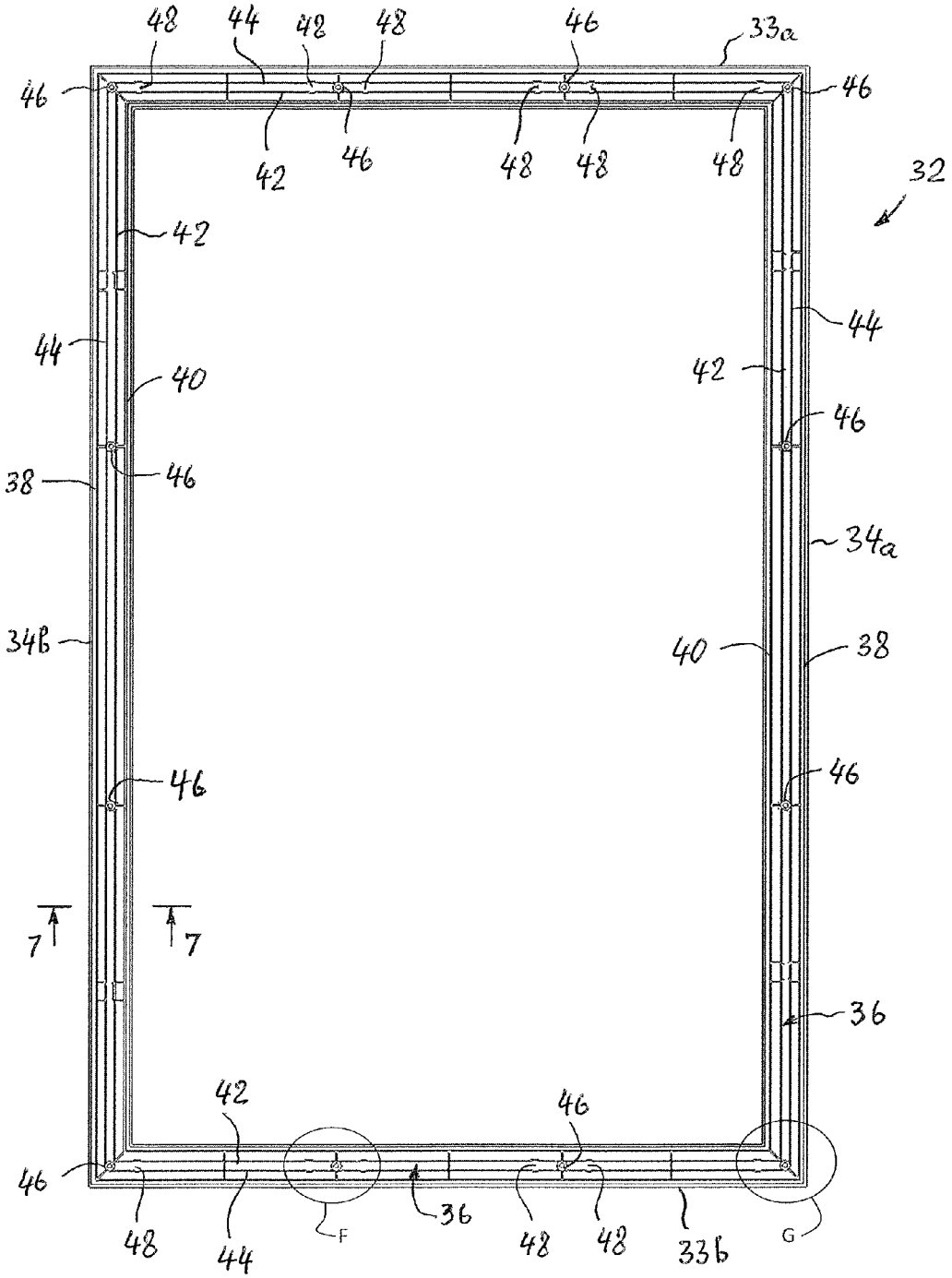
FIG. 5B is a rear view of the door lite frame component of FIG. 3.
Figure 5C:
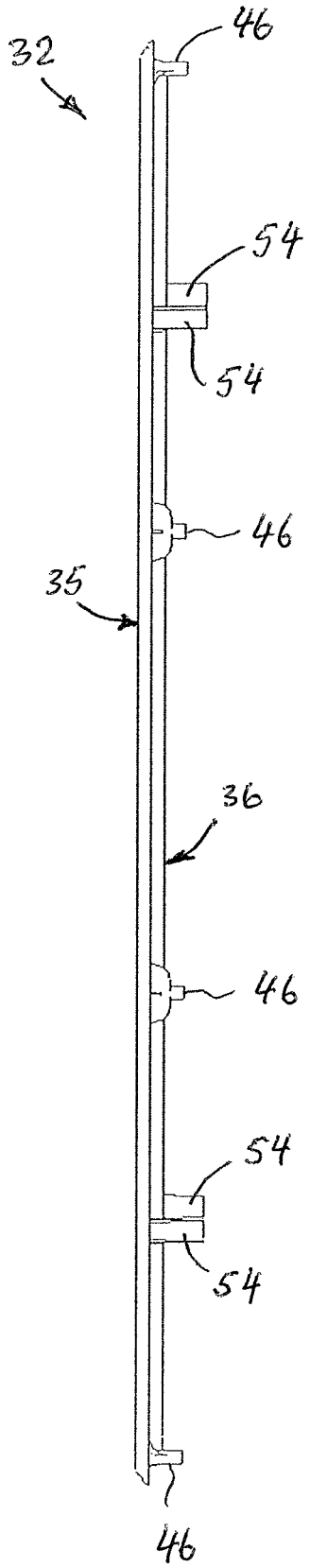
FIG. 5C is a side view of the door lite frame component of FIG. 3.

The interior side 36 of each of the frame halves 32, best illustrated in FIGS. 3 and 5B, includes a number of substantially identical, cylindrical screw bosses (or posts) 46 outwardly extending from the interior side 36 of the door lite frame half 32 and sized to receive frame connectors (also referred to herein as fasteners) for joining the first and second frame halves $\mathbf{32}_1$ and $\mathbf{32}_2$ to one another. It should be noted that if appropriate the screw bosses of the first frame half $\mathbf{32}_1$ (or first screw bosses) are on occasion marked with the numeral character $\mathbf{46}_1$, while the screw bosses of the second frame half $\mathbf{32}_2$ (or second screw bosses) are on occasion marked with the numeral character $\mathbf{46}_2$, as shown in FIGS. 8, 9A-10C, 12B, 13A and 13B. However, in view of the structural similarities of the screw bosses $\mathbf{46}_1$ and $\mathbf{46}_2$ and in the interest of simplicity, the following discussion will use the reference numeral 46 when generically referring to the screw bosses rather than reciting two different reference numerals $\mathbf{46}_1$ and $\mathbf{46}_2$ of the first and second frame halves $\mathbf{32}_1$ and $\mathbf{32}_2$. As the frame half 32 is a single-piece injection molded component, the screw bosses 46 are integral with the frame half 32.

As illustrated in FIGS. 3, 4A, 4B, 4E, 5A, 5B, 6A, 6B, 8, 9A, 9B, 10A and 12A, the screw bosses $\mathbf{46}_1$ of the interior (or first) frame half $\mathbf{32}_1$ are provided with through holes $\mathbf{47}_1$ open on both the exposed exterior side 35 and the interior side 36 of the interior frame half $\mathbf{32}_1$, while the screw bosses $\mathbf{46}_2$ of the exterior (or second) frame half $\mathbf{32}_2$ are provided with blind holes $\mathbf{47}_2$ open only on the interior side 36 of the exterior frame half $\mathbf{32}_2$. Moreover, the interior diameter of the screw bosses 46 of the interior (first) frame half $\mathbf{32}_1$ (i.e., the diameter of the through hole $\mathbf{47}_1$) is slightly larger than the interior diameter of the screw bosses 46 of the exterior (second) frame half $\mathbf{32}_2$ (i.e., the diameter of the blind hole $\mathbf{47}_2$). Thus, as noted above, the two door lite frame halves $\mathbf{32}_1$ and $\mathbf{32}_2$ are substantially identical because the only significant differences between them are: 1) the through holes $\mathbf{47}_1$ in the interior frame half $\mathbf{32}_1$, and the blind holes $\mathbf{47}_2$ in the exterior frame half $\mathbf{32}_2$, and 2) the interior diameter of the screw bosses 46 of the interior frame half $\mathbf{32}_1$ is slightly larger than the interior diameter of the screw bosses 46 of the exterior frame half $\mathbf{32}_2$.

Figure 4A:
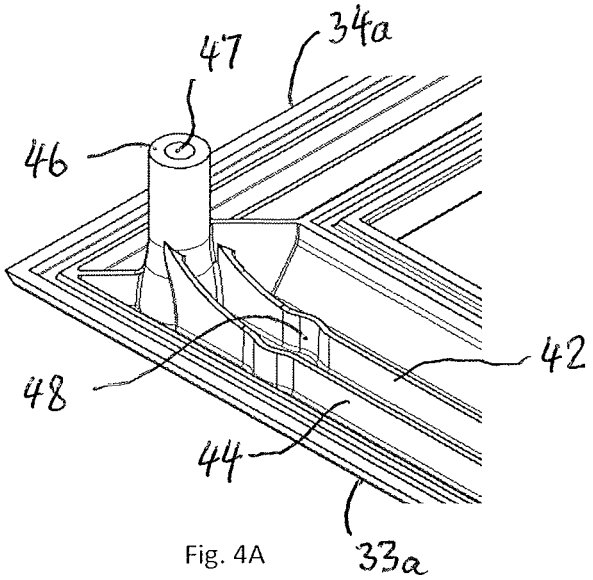
FIG. 4A is an enlarged perspective view of a fragment of the door lite frame component shown in a circle "A" of FIG. 3.
Figure 4B:
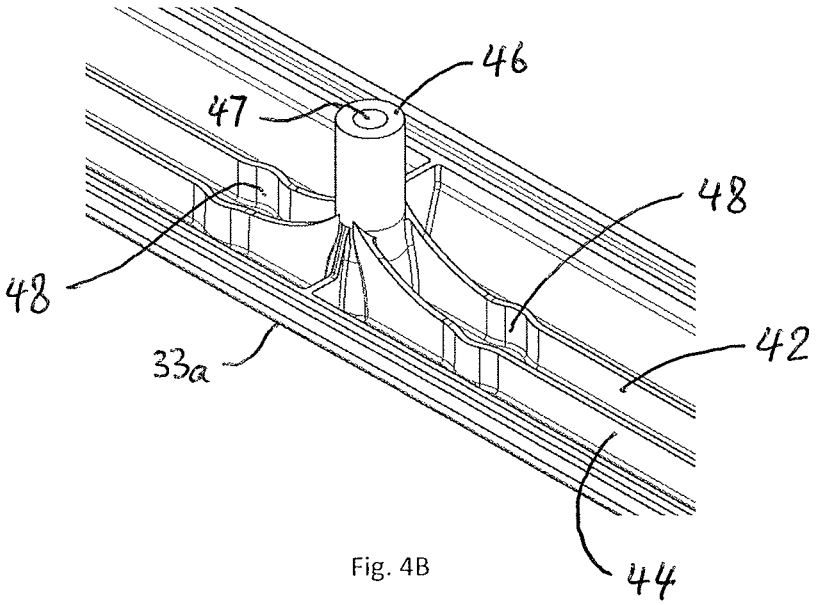
FIG. 4B is an enlarged perspective view of a fragment of the door lite frame component shown in circle "B" of FIG. 3.
Figure 4C:
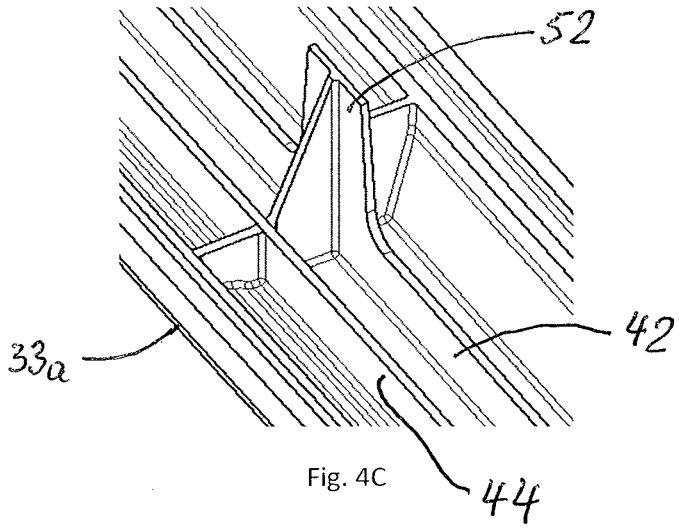
FIG. 4C is an enlarged perspective view of a fragment of the door lite frame component shown in circle "C" of FIG. 3.
Figure 4D:
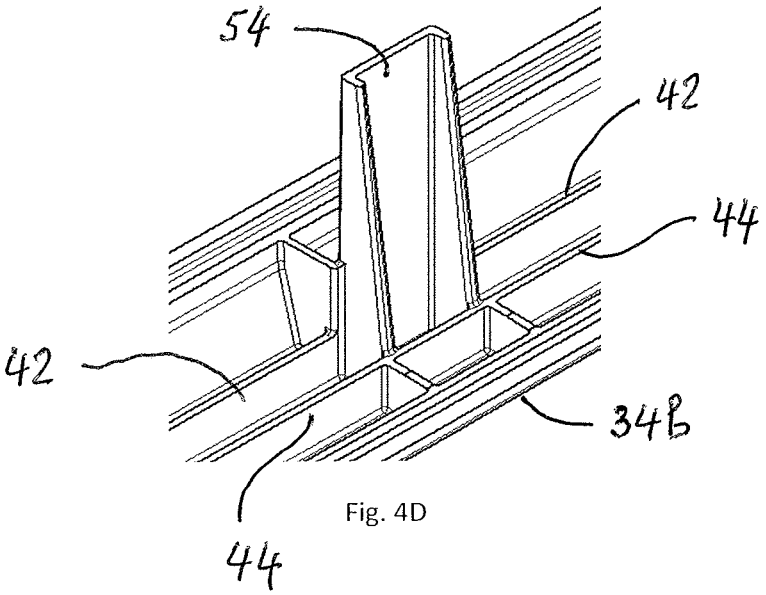
FIG. 4D is an enlarged perspective view of a fragment of the door lite frame component shown in circle "D" of FIG. 3.
Figure 4E:
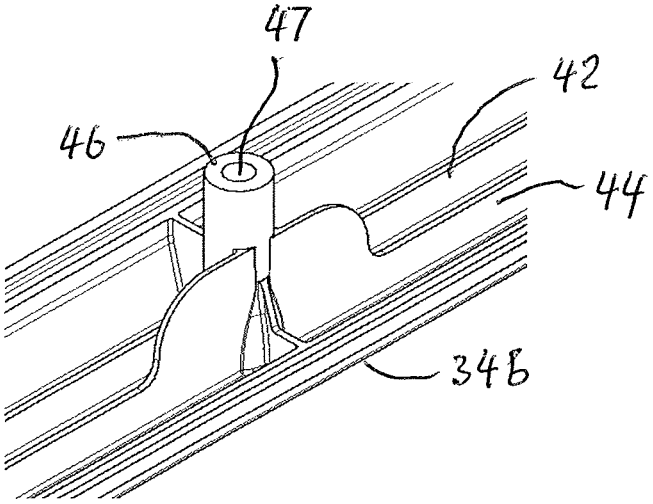
FIG. 4E is an enlarged perspective view of a fragment of the door lite frame component shown in circle "E" of FIG. 3.

As best illustrated in FIGS. 3 and 4C, each of the frame halves 32 further includes a number of generally identical glass supports 52 outwardly extending from the interior side 36 of the top and bottom frame members 33*a* and 33*b* of the door lite frame half 32 in parallel with the screw bosses 46 and provided to support the translucent panel 16 within the assembled door lite frame 30, i.e., when the first and second frame halves $\mathbf{32}_1$ and $\mathbf{32}_2$ are joined to one another.

Figure 11:
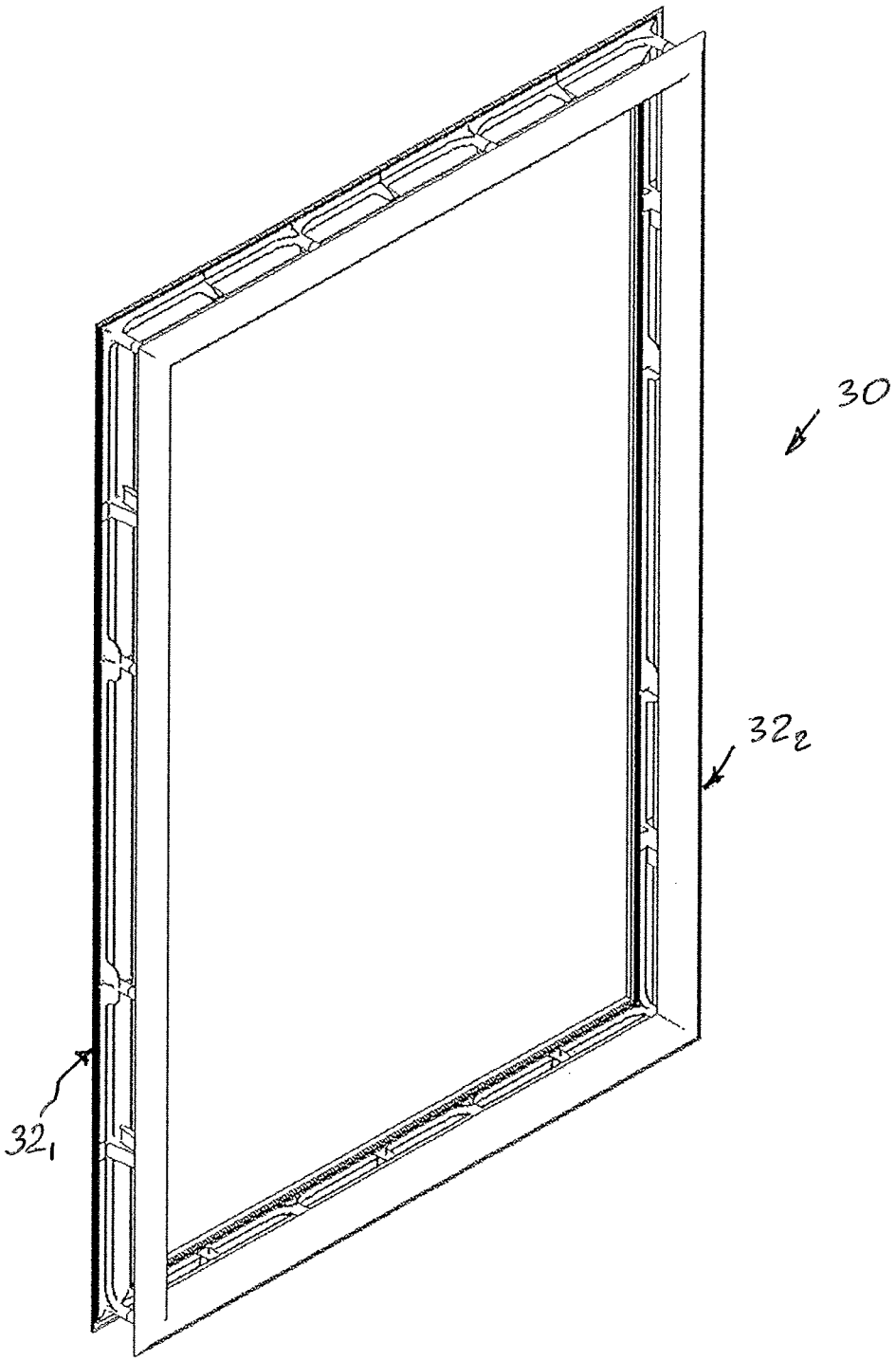
FIG. 11 is a perspective view of the door lite frame components of FIG. 8 arranged in an assembled state.
Figure 12A:
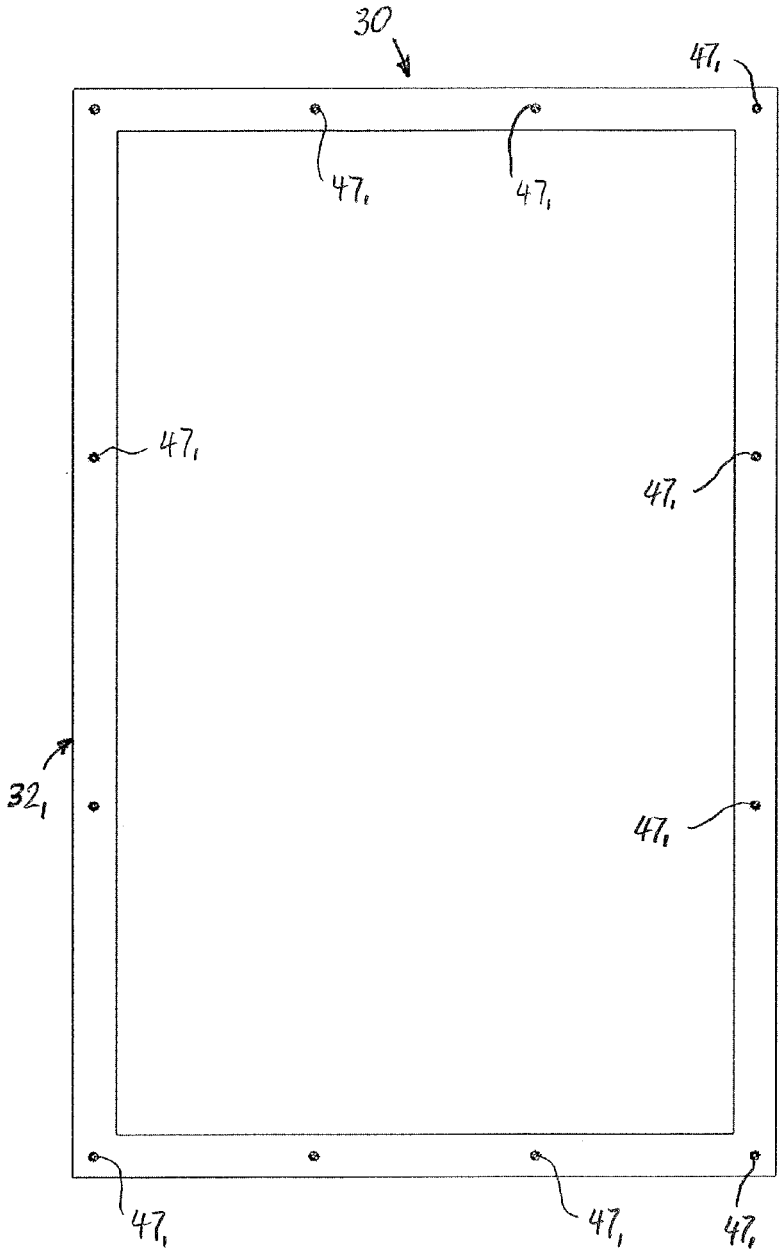
FIG. 12A is a front view of the door lite frame components of FIG. 8 arranged in the assembled state.
Figure 12B:
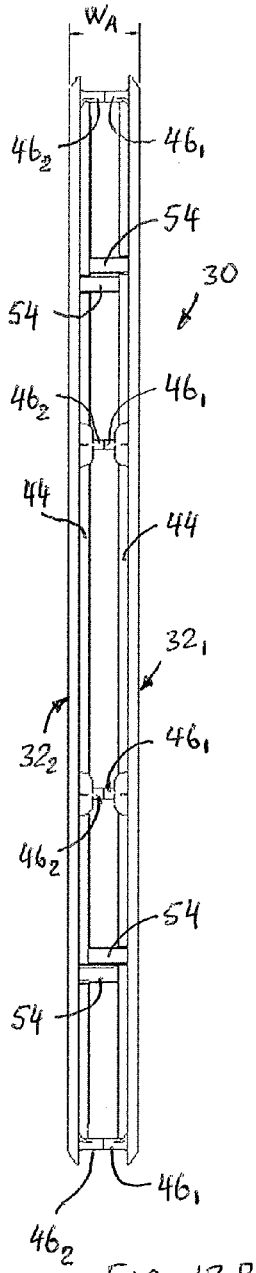
FIG. 12B is a side view of the door lite frame components of FIG. 8 arranged in the assembled state.
Figure 13A:
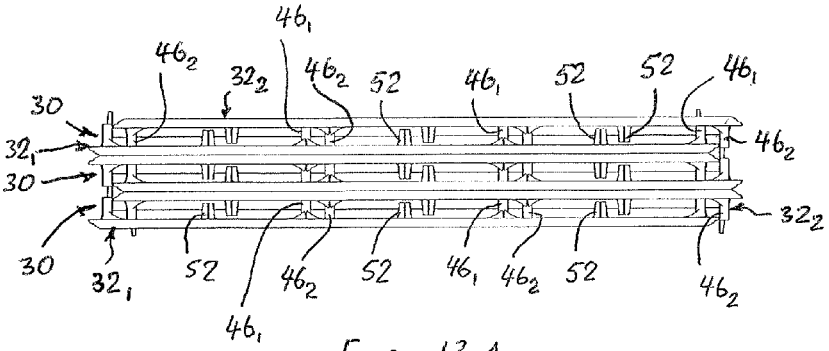
FIG. 13A is an end side view of a plurality of sets of nested door lite frame components stacked on one another.
Figure 13B:
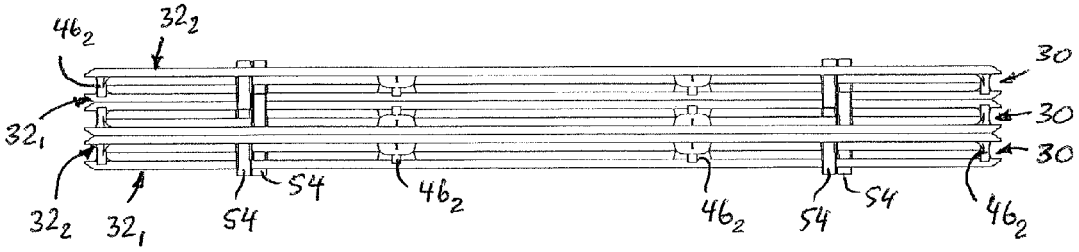
FIG. 13B is side view of the plurality of nested door lite frame components of FIG. 13A.

In the assembled state of the door lite frame 30, as illustrated in FIGS. 11, 12A and 12B, the screw bosses 46 of the opposite frame halves $\mathbf{32}_1$ and $\mathbf{32}_2$ are complementary to and coaxial (i.e., in registry) with each other so that distal ends of the screw bosses 46 of the opposite frame halves $\mathbf{32}_1$ and $\mathbf{32}_2$ are facing each other. The screw bosses 46 of the opposite frame halves $\mathbf{32}_1$ and $\mathbf{32}_2$ may be axially juxtaposed or separated by a gap. Such an arrangement allows for the translucent panel 16 of varying thickness and construction to be accommodated through the use of additional spacers or support pieces.

The opposite frame halves $\mathbf{32}_1$ and $\mathbf{32}_2$ are joined together by screws extending through the screw bosses 46 of the both opposite frame halves $\mathbf{32}_1$ and $\mathbf{32}_2$. The screw bosses 46 of the frame half 32 are preferably situated at uniform (or, alternatively, non-uniform) spaced intervals along each of the frame members 33*a*, 33*b*, 34*a* and 34*b* of the door lite frame half 32. In the illustrated embodiment of FIGS. 3 and 5B, four of the screw bosses 46 are disposed at the intersection of the frame members 33*a*, 33*b*, 34*a* and 34*b* (i.e., corner bosses) and two of the uniformly spaced screw bosses 46 are disposed on each of the frame members 33*a*, 33*b*, 34*a* and 34*b*.

The interior side 36 of the frame half 32, best illustrated in FIGS. 3-4E and 5B, comprises a pair of integrally molded reinforcing ribs 42 and 44 both extending between the screw bosses 46 and around an entire perimeter of the frame half 32, i.e., along the frame members 33*a*, 33*b* and 34*a*, 34*b*, substantially parallel to each other. The ribs 42 and 44 provide enhanced structural integrity for the frame half 32, and they also support the other frame components discussed below. As the frame half 32 may be a single-piece (monolithic) injection molded component, the ribs 42 and 44 are integral with the frame half 32 and with one another. As best illustrated in FIGS. 6A and 6B, an outer diameter $D_1$ of each of the screw bosses 46 is larger than a distance k between the parallel ribs 42 and 44.

Each frame half 32 further includes a number of substantially identical, cylindrical grip sockets 48 each formed on the interior side 36 of the frame half 32 by curvilinear portions of the parallel ribs 42, 44. It should be noted that if appropriate the grip sockets of the first frame half $\mathbf{32}_1$ could be defined as first grip sockets, while the grip sockets of the second frame half $\mathbf{32}_2$ could be defined as second grip sockets. Each of the grip sockets 48 is spaced from but adjacent to the one of the screw bosses 46. In other words, the grip sockets 48 of one of the frame halves 32 are offset from the screw bosses 46 on another frame half 32 when the screw bosses 46 of the first and second frame halves $\mathbf{32}_1$, $\mathbf{32}_2$ are engaged, i.e., when the first and second frame halves $\mathbf{32}_1$, $\mathbf{32}_2$ are in the assembled state. According to the exemplary embodiment of the present invention, as illustrated in FIGS. 3 and 5B, only one pair of the opposite frame members, i.e., the top and bottom frame members 33*a* and 33*b*, is provided with the grip sockets 48. Moreover, the number of the grip sockets 48 provided on a particular frame member, e.g., 33*a*, may be greater than the number of the screw bosses 46 provided on that same frame member, as shown with respect to frame member 33*a* in FIG. 5B.

Although, the screw bosses 46 and the grip sockets 48 are described and shown in the accompanying drawings as being substantially cylindrical, it will be appreciated that that the screw bosses 46 and the grip sockets 48 may be of any other appropriate configuration, such as oval, rectangular, hexagonal, triangular, etc.

Figure 6A:
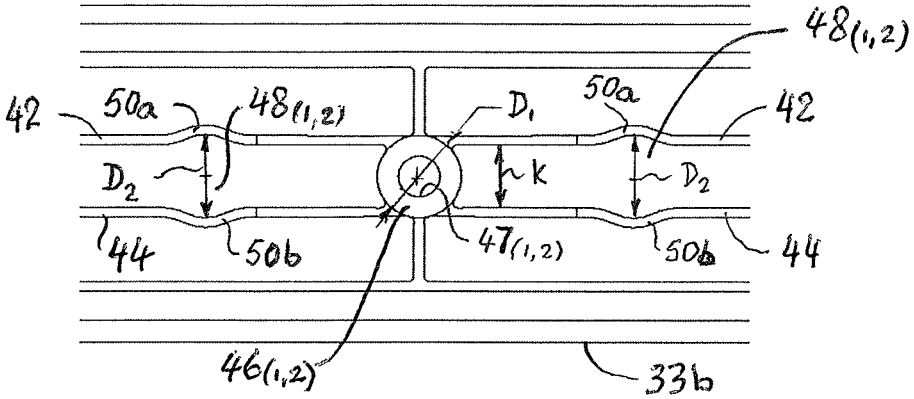
FIG. 6A is an enlarged view of a fragment of the door lite frame component shown in circle "F" of FIG. 5B.
Figure 6B:
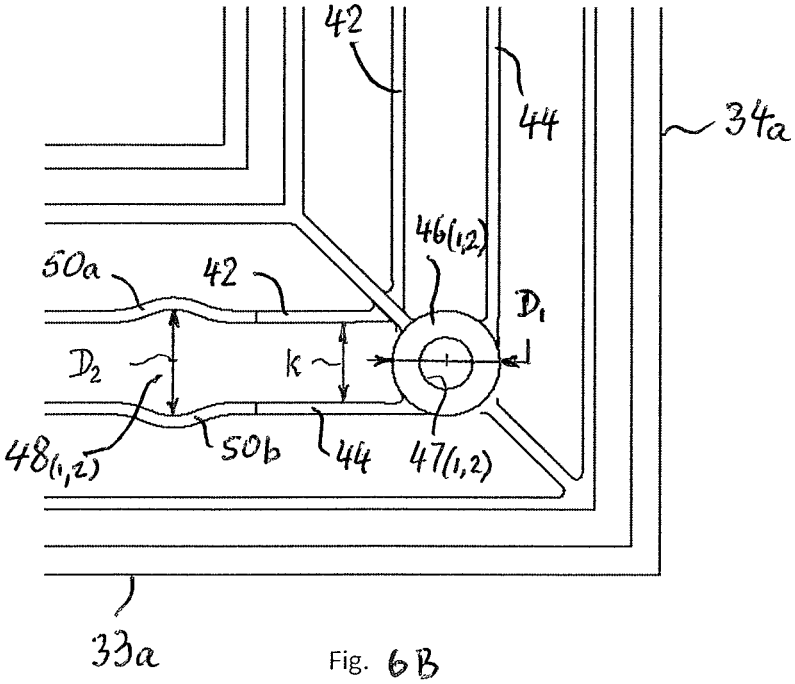
FIG. 6B is an enlarged view of a fragment of the door lite frame component shown in circle "G" of FIG. 5B.
Figure 7A:
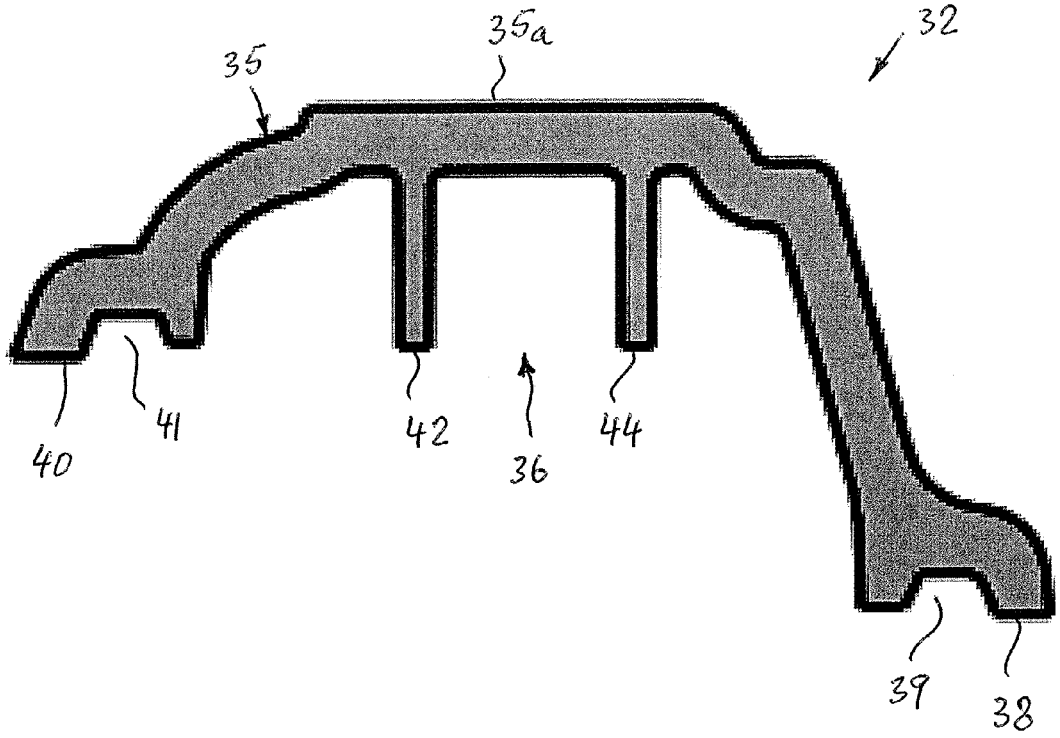
FIG. 7A is a cross-sectional view of the door lite frame taken along the sectional line 7A-7A of FIG. 5B.
Figure 7B:
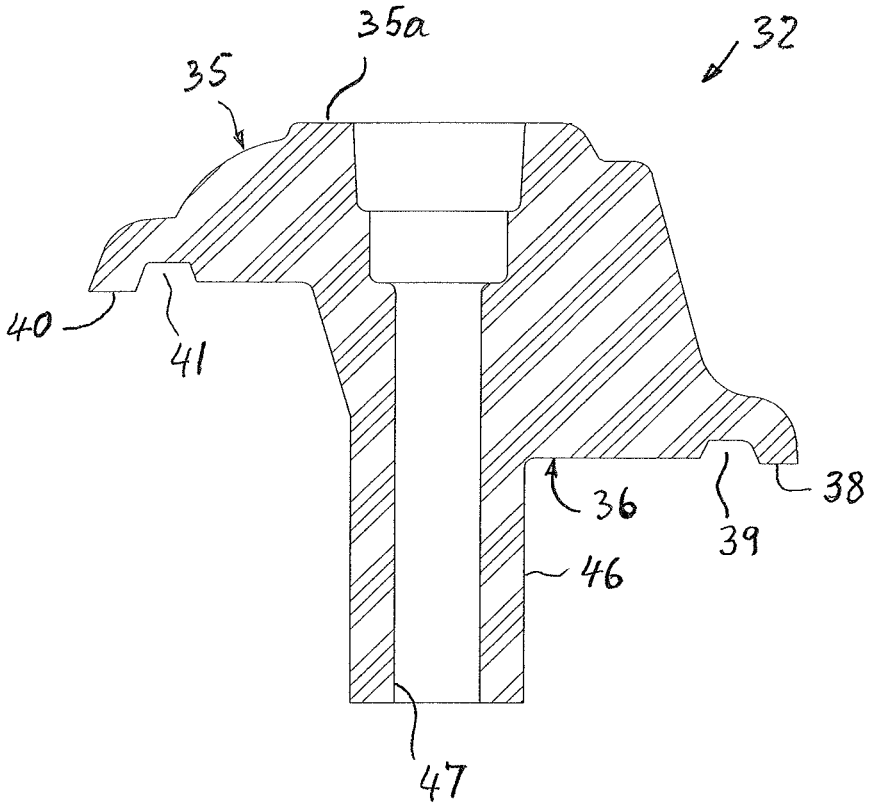
FIG. 7B is a cross-sectional view of the door lite frame taken along the sectional line 7B-7B of FIG. 5B.
Figure 8:
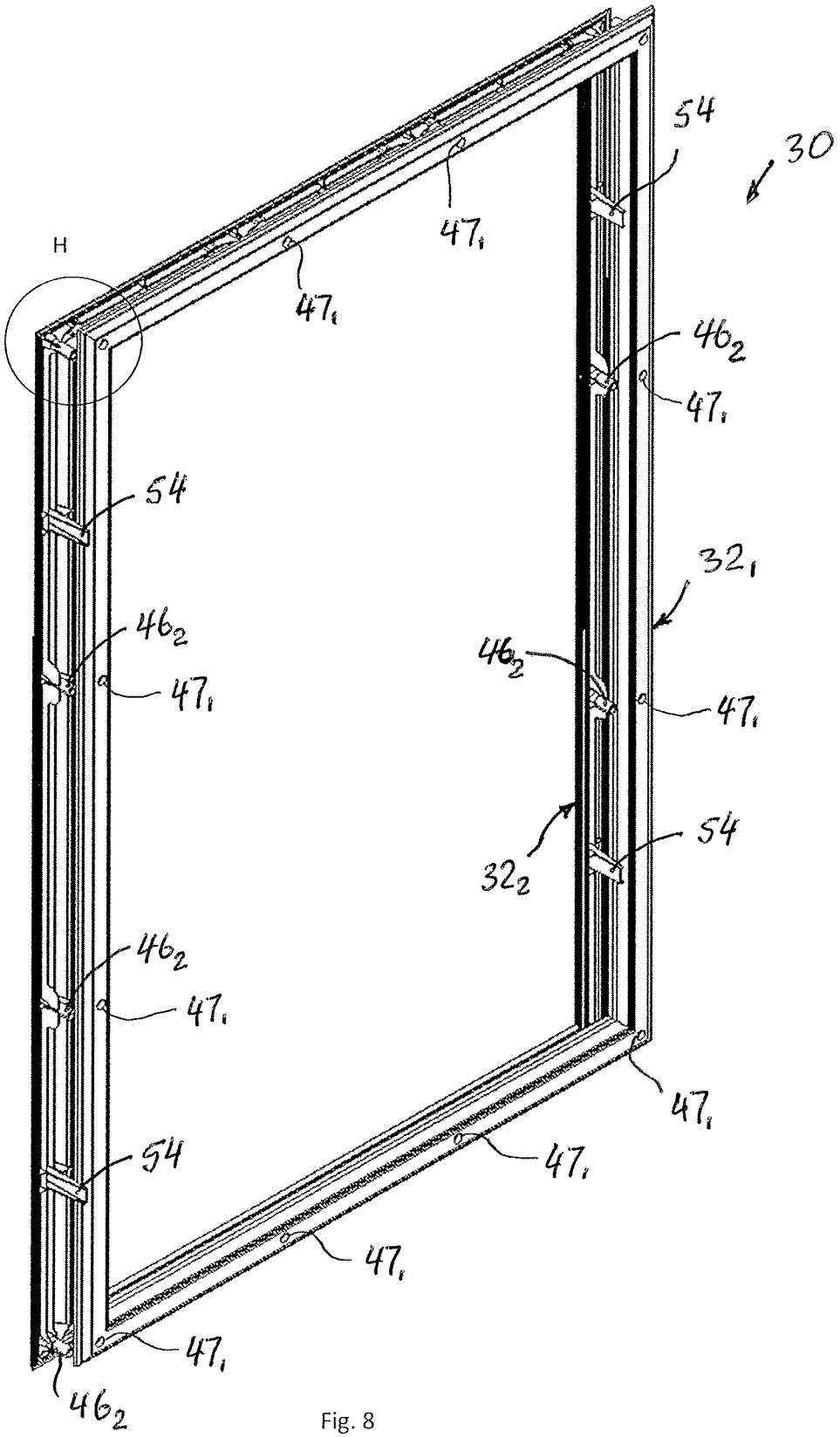
FIG. 8 is a perspective view of first and second door lite frame components in a nested state.

As illustrated in detail in FIGS. 6A and 6B, each of the grip sockets 48 is formed by two opposite curvilinear portions 50*a* and 50*b* of the opposite parallel ribs 42 and 44, respectively. Moreover, each of the grip sockets 48 of one of the frame halves 32 is dimensioned for frictionally receiving the screw boss 46 of another frame half 32. Specifically, a maximum distance $D_2$ between the opposite semi-cylindrical portions 50*a* and 50*b* of each of the grip sockets 48 (i.e., the diameter of the grip socket 48) is slightly smaller than the outer diameter $D_1$ of each of the screw bosses 46 so as to provide a friction-fit connection between the screw bosses 46 of one (the first or second) frame half ($\mathbf{32}_1$ or $\mathbf{32}_2$) and the grip sockets 48 of another (the second or first) frame half ($\mathbf{32}_2$ or $\mathbf{32}_1$). According to the present invention, the number of the screw bosses 46 on one of the first frame half $\mathbf{32}_1$ is equal to the number of the screw bosses 46 on the opposite, second frame half $\mathbf{32}_2$, while the number of the grip sockets 48 on the top and bottom frame members 33*a* and 33*b* is bigger than the number of the screw bosses 46.

The first and second frame halves $\mathbf{32}_1$ and $\mathbf{32}_2$ may be connected to one another in either the assembled state or the nested state. In the assembled state, the rectangular frame halves $\mathbf{32}_1$ and $\mathbf{32}_2$ are aligned with and overlie one another. In the nested state, the rectangular frame halves $\mathbf{32}_1$ and $\mathbf{32}_2$ are slightly offset from one another.

In the assembled state, shown in FIGS. 1, 11, 12A and 12B, the first and second frame halves $\mathbf{32}_1$, $\mathbf{32}_2$ are oriented opposite relative to each other so that the interior side 36 of the first frame half $\mathbf{32}_1$ faces the interior side 36 of the second frame half $\mathbf{32}_2$ and the screw bosses 46 of the first and second frame halves $\mathbf{32}_1$, $\mathbf{32}_2$ are aligned with one another. The first and second frame halves $\mathbf{32}_1$ and $\mathbf{32}_2$ are fastened to each other in the assembled position by screws extending through the through hole $\mathbf{47}_1$ in the first (interior) frame half $\mathbf{32}_1$ and the blind hole $\mathbf{47}_2$ in the screw bosses 46 of the second (exterior) frame half $\mathbf{32}_2$. Because the frame 30 is sized to fit snugly in the openings of the door skins 19, 20, and to receive the glazing member 16 between the frame halves $\mathbf{32}_1$ and $\mathbf{32}_2$, the frame 30 effectively interconnects the door body 14 to the glazing member 16.

Figure 9A:
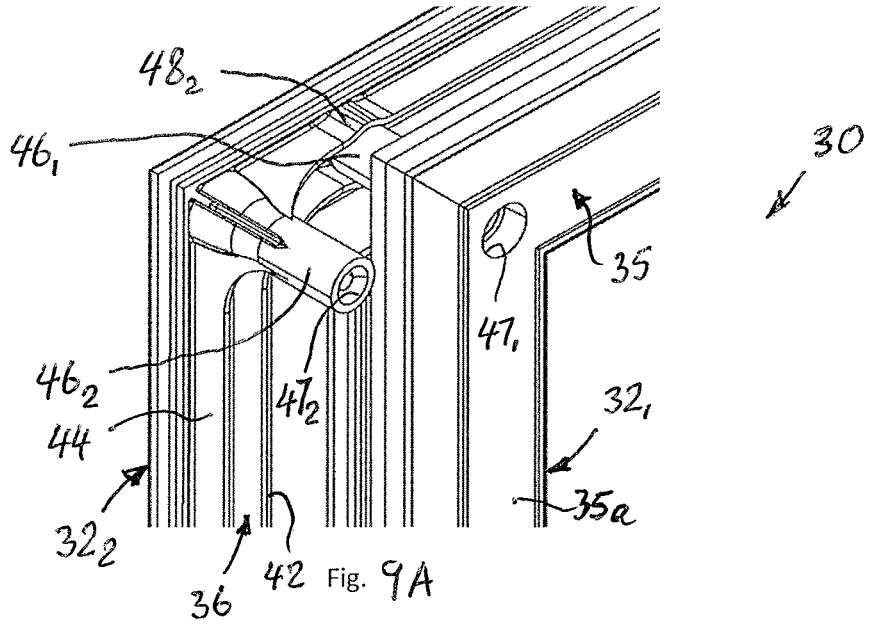
FIG. 9A is an enlarged perspective view of a fragment of the door lite frame components in the nested state shown in circle "H" of FIG. 8.
Figure 9B:
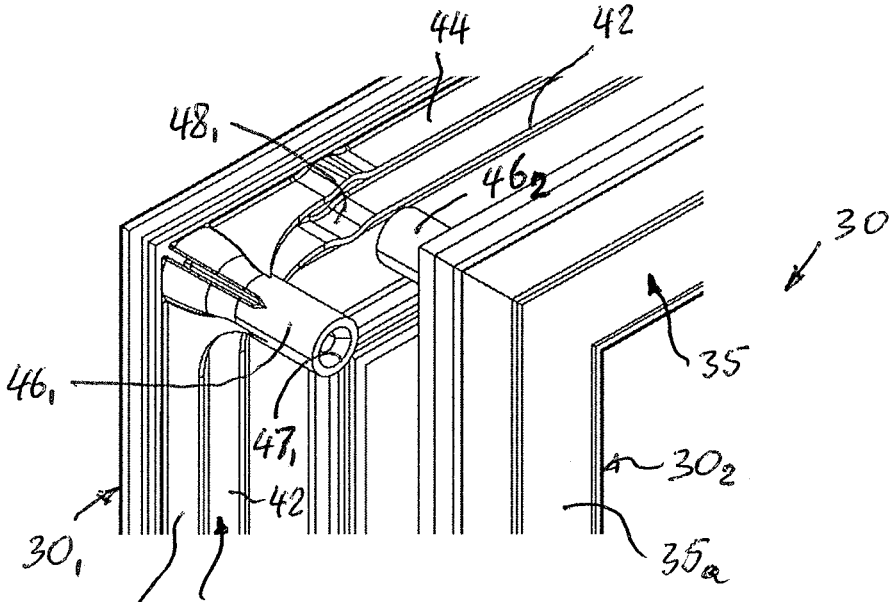
FIG. 9B is an enlarged perspective view of a fragment of the door lite frame components of FIG. 8 separated from each other so that screw bosses of one frame component are aligned with grip sockets of the other frame component.

In the nested state, shown in FIGS. 8, 9A, 9B and 10B, the first and second frame halves $\mathbf{32}_1$, $\mathbf{32}_2$ are oriented relative to each other so that at least one, and optionally a plurality (but not all), of the screw bosses 46 of one of the frame halves 32 are mated with the corresponding number of the second grip sockets 48 of another (opposite) of the frame halves 32. Specifically, according to the exemplary embodiment of the present invention, the screw bosses 46 of one of the frame halves 32 are frictionally received in the grip sockets 48 of another of the frame halves 32 so as to provide a friction-fit connection between the first and second frame halves $\mathbf{32}_1$ and $\mathbf{32}_2$. Further specifically, in the nested state, one or more (but not all) of the first screw bosses $\mathbf{46}_1$ of the first frame half $\mathbf{32}_1$ correspond with and are frictionally received in one or more of the second grip sockets $\mathbf{48}_2$ of the second frame component $\mathbf{32}_2$. At the same time, one or more (but not all) of the second screw bosses $\mathbf{46}_2$ of the second frame half $\mathbf{32}_2$ correspond with and are frictionally received in one or more of the first grip sockets $\mathbf{48}_1$ of the first frame component $\mathbf{32}_1$. To do so, first, the first and second frame halves $\mathbf{32}_1$, $\mathbf{32}_2$ are oriented relative to each other so that the interior side 36 of the first frame half $\mathbf{32}_1$ faces the interior side 36 of the second frame half $\mathbf{32}_2$ and the screw bosses 46 of the first and second frame halves $\mathbf{32}_1$, $\mathbf{32}_2$ are aligned with one another. Next, one of the frame halves 32 is moved in translation (i.e., along the straight line) relative to another frame half 32 within its own plane and along the top and bottom frame members 33*a* and 33*b* (that is, widthwise and lengthwise) so that at least one of the screw bosses 46 of one of the frame halves 32 is aligned with a corresponding grip sockets 48 of another frame half 32. Because the number of the grip sockets 48 on the top and bottom frame members 33*a* and 33*b* is bigger than the number of the screw bosses 46, one of the frame halves 32 can be conveniently shifted relative to another frame half 32 within its own plane widthwise in any of the opposite directions (i.e. either left or right). As shown in FIG. 9B, multiple screw bosses 46 and grip sockets 48 are aligned. Then, one of the frame halves 32 is moved toward the other of the frame halves 32 (or both frame halves are moved) so that the one or more screw bosses 46 of one of the frame halves 32 are frictionally engaged in the aligned one or more grip sockets 48 of another of the frame halves 32, thus providing the friction-fit connection between the first and second frame halves $\mathbf{32}_1$ and $\mathbf{32}_2$, as shown in FIGS. 8, 9A, 10A and 10B. Moreover, the screw bosses 46 nested in the grip sockets 48 also prevent warping of the frame halves 32 during the storage and/or transportation.

Figure 10A:
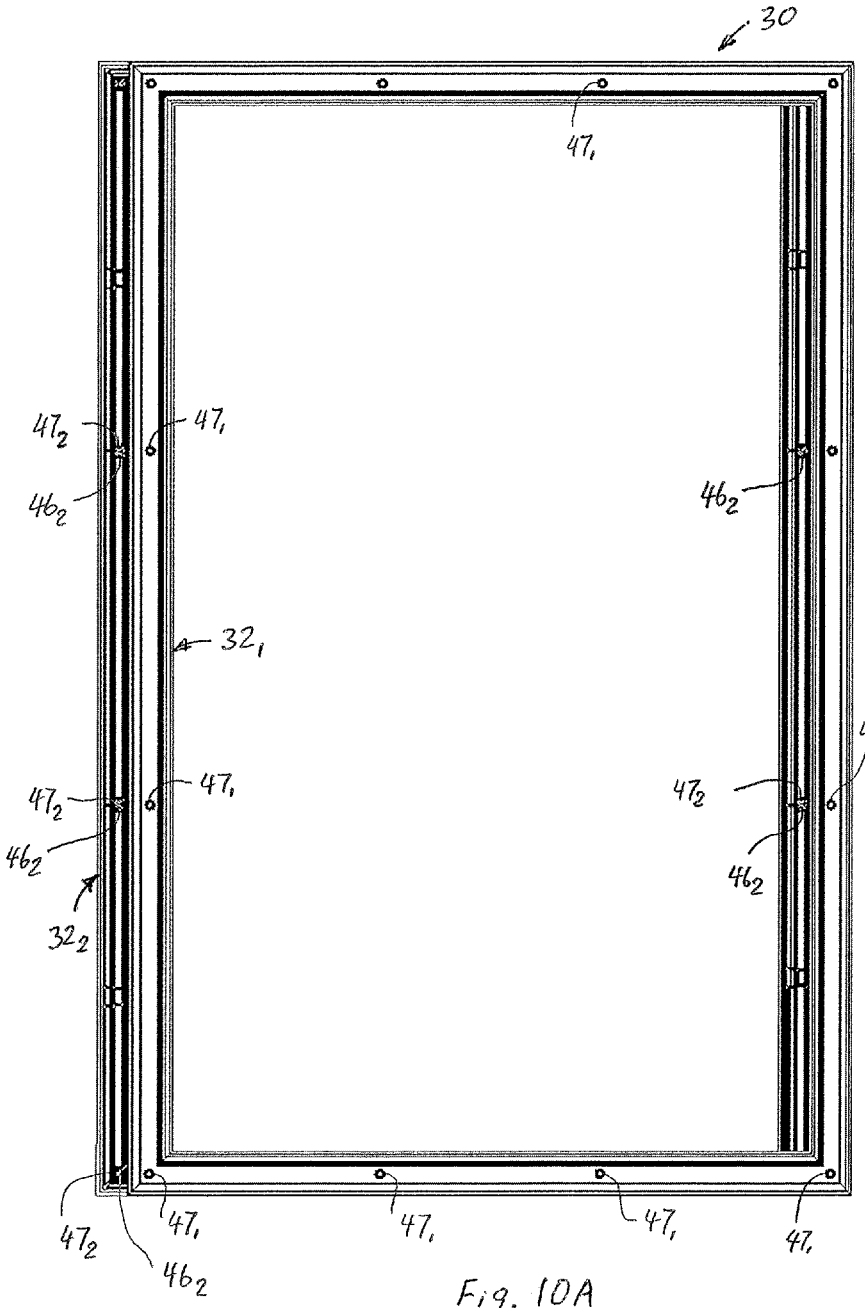
FIG. 10A is front view of the door lite frame components of FIG. 8 in the nested state.
Figure 10B:
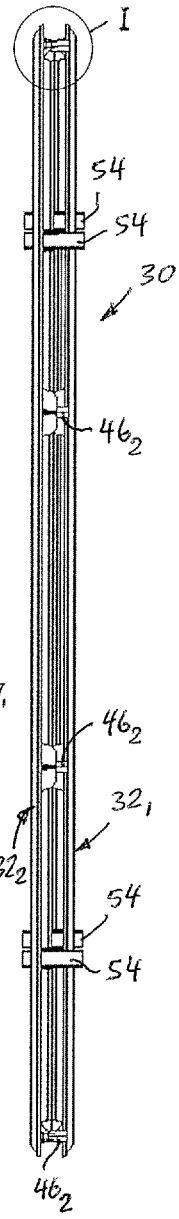
FIG. 10B is a side view of the door lite frame components of FIG. 8 in the nested state.
Figure 10C:
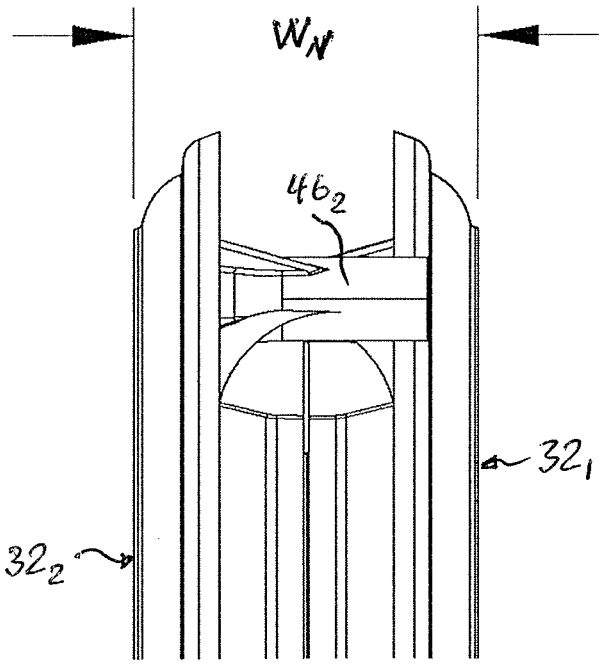
FIG. 10C is an enlarged view of a fragment of the door lite frame components in the nested state shown in circle "I" of FIG. 10B.

The depth $W_N$ of the door lite frame 30 in the nested state, shown in FIG. 10C, is substantially smaller than the depth $W_A$ of the door lite frame 30 in the assembled state, shown in FIG. 12B. For example, in one embodiment, the depth $W_A$ of the door lite frame 30 in the assembled state equals 2.427", the depth $W_N$ thereof in the nested position equals 1.427", or 1" less. Accordingly, the door lite frame in accordance with the exemplary embodiments significantly reduces the shipping/storing size of the stacked-up door lite frames shown in FIGS. 13A and 13B.

As best illustrated in FIGS. 3, 4D, 8, 10B, 12B and 13B, each of the right and left side frame members 34*a* and 34*b* of at least one of the frame half 32 further includes two generally identical anti-twist supports 54 outwardly extending from the interior side 36 of the right and left side frame members 34*a* and 34*b* of the door lite frame half 32. The supports 54 are provided to prevent twisting of the first and second frame halves $\mathbf{32}_1$ and $\mathbf{32}_2$ when the first and second frame halves $\mathbf{32}_1$ and $\mathbf{32}_2$ are joined to each other, such as during frame assembly.

Therefore, the first and second frame halves of the exemplary door lite frame embodied herein can be easily and cost-effectively nested together when transported and/or stored, thereby lowering transportation/storage costs by reducing the shipping/storing size, and preventing warping of the frame halves during the storage and/or transportation.

The foregoing description of the exemplary embodiments of the present invention has been presented for the purpose of illustration in accordance with the provisions of the Patent Statutes. It is not intended to be exhaustive or to limit the invention to the precise forms disclosed. Obvious modifications or variations are possible in light of the above teachings. The embodiments disclosed hereinabove were chosen in order to best illustrate the principles of the present invention and its practical application to thereby enable those of ordinary skill in the art to best utilize the invention in various embodiments and with various modifications as are suited to the particular use contemplated, as long as the principles described herein are followed. Thus, changes can be made in the above-described invention without departing from the intent and scope thereof. It is also intended that the scope of the present invention be defined by the claims appended thereto.

What is claimed is:

1. A door lite frame comprising:

a first frame component comprising first screw bosses and first grip sockets; and a second frame component comprising second screw bosses and second grip sockets;

said first and second frame components constructed to permit arrangement of said first and second frame components in an assembled state and a nested state with respect to one another;

wherein in said assembled state, said first screw bosses being correspondingly aligned with said second screw bosses, and said first and second frame components being secured to each other; and wherein in said nested state, at least one of said first screw bosses of said first frame component mating with at least one of said second grip sockets of said second frame component.

2. The door lite frame as defined in claim 1, wherein in the nested state, at least one of said second screw bosses of said second frame component mating with at least one of said first grip sockets of said first frame component.

3. The door lite frame as defined in claim 2, wherein each of said first and second frame components has an exposed exterior side and an interior side located opposite said exterior side.

4. The door lite frame as defined in claim 3, wherein said interior side includes a door engagement portion and a glass engagement portion.

5. The door lite frame as defined in claim 3, wherein said first and second screw bosses outwardly extend from said interior side of each of said first and second frame components, respectively.

6. The door lite frame as defined in claim 5, wherein said first and second screw bosses are sized to receive frame fasteners for joining said first and second frame components to one another.

7. The door lite frame as defined in claim 5, wherein said first and second grip sockets are formed on said interior side of each of said first and second frame components, respectively.

8. The door lite frame as defined in claim 7, wherein each of said grip sockets of each of said first and second frame components is spaced from and adjacent to one of said screw bosses of the same one of said first and second frame components so that said grip sockets of one of said first and second frame components are offset from said screw bosses of another of said first and second frame components when when said first and second frame components are in the assembled state.

9. The door lite frame as defined in claim 7, wherein said interior side of each of said first and second frame components comprises a pair of ribs both extending between said screw bosses substantially parallel to each other.

10. The door lite frame as defined in claim 9, wherein each of said grip sockets of each of said first and second frame components is formed by opposite curvilinear portions of said parallel ribs.

11. The door lite frame as defined in claim 10, wherein each of said grip sockets of each of said first and second frame components is dimensioned for frictionally receiving said screw bosses of another of said first and second frame components.

12. The door lite frame as defined in claim 3, wherein each of said first and second frame components further comprises a number of glass supports outwardly extending from said interior side.

13. The door lite frame as defined in claim 1, wherein said first and second screw bosses are substantially identical.

14. The door lite frame as defined in claim 13, wherein said first and second grip sockets are substantially identical.

15. The door lite frame as defined in claim 1, wherein in the nested state, at least one of said first screw bosses of said first frame component corresponding with and frictionally received in at least one of said second grip sockets of said second frame component.

16. The door lite frame as defined in claim 15, wherein in the nested state, at least one of said second screw bosses of said second frame component corresponds with and is frictionally received in at least one of said first grip sockets of said first frame component.

17. A door, comprising:

a door body having an opening therethrough;

a door lite frame secured to said door body so as to extend about a periphery of said opening; and a glazing panel having a periphery and positioned within said door lite frame so that said door lite frame extending along said periphery of said glazing panel;

said door lite frame comprising:

a first frame component comprising first screw bosses and first grip sockets; and a second frame component comprising second screw bosses and second grip sockets;

said first and second frame components constructed to permit arrangement of said first and second frame components in an assembled state and a nested state with respect to one another;

wherein in said assembled state, said first screw bosses are correspondingly aligned with said second screw bosses, and said first and second frame components are adapted to extend along said periphery of said glazing panel for securing said glazing panel to said door body; and wherein in said nested state, at least one of said first screw bosses of said first frame component mating with at least one of said second grip sockets of said second frame component.

18. The door as defined in claim 17, wherein said door body comprises a door frame having opposite first and second faces, a first door skin with a first opening secured to said first face of said door frame, and a second door skin with a second opening secured to said second face of said door frame so that said first and second openings are aligned with one another; and wherein said door lite frame is secured to said first and second door skins so as to extend about peripheries of said first and second openings.

19. The door as defined in claim 17, wherein in the nested state, at least one of said second screw bosses of said second frame component mating with at least one of said first grip sockets of said first frame component.

20. The door as defined in claim 17, wherein each of said first and second frame components further comprises a number of glass supports outwardly extending from an interior side thereof facing said glazing panel, said glass supports provided to support said glazing panel within said door lite frame when said first and second frame components are in said assembled state.

21. The door as defined in claim 17, wherein at least one of said first and second frame components further comprises two anti-twist supports outwardly extending from an interior side thereof facing said glazing panel; said anti-twist supports are provided to prevent twisting of said first and second frame components when said first and second frame components are in said assembled state.

* * * * *